US006792992B2

(12) United States Patent
Goetz

(10) Patent No.: US 6,792,992 B2
(45) Date of Patent: Sep. 21, 2004

(54) LABEL APPLICATION DEVICE INCLUDING A FLOW CONTROL ELEMENT

(75) Inventor: Robert R. Goetz, Garden Grove, CA (US)

(73) Assignee: FMC Technologies Inc., Chicago, IL (US)

( * ) Notice: Subject to any disclaimer, the term of this patent is extended or adjusted under 35 U.S.C. 154(b) by 83 days.

(21) Appl. No.: 10/099,241

(22) Filed: Mar. 15, 2002

(65) Prior Publication Data

US 2003/0173034 A1 Sep. 18, 2003

(51) Int. Cl.[7] ..... B65C 3/00; B65C 9/36

(52) U.S. Cl. ..... 156/567; 156/542; 156/556; 156/566; 156/DIG. 5; 156/DIG. 37; 156/DIG. 42

(58) Field of Search ..... 156/351, 358, 156/363, 538, 539, 540, 541, 542, 556, 566, 567, 571, 572, DIG. 5, DIG. 37, 42, 568, DIG. 38

(56) References Cited

U.S. PATENT DOCUMENTS

| | | | |
|---|---|---|---|
| 1,085,077 | A | 1/1914 | Ballard |
| 2,266,087 | A | 12/1941 | Schlemmer |
| 2,690,104 | A | 9/1954 | Schwartz et al. |
| 2,765,205 | A | 10/1956 | Capella et al. |
| 2,933,216 | A | 4/1960 | Cole |
| 3,158,522 | A | 11/1964 | Dreher |
| 3,196,430 | A | 7/1965 | Messmer et al. |

(List continued on next page.)

FOREIGN PATENT DOCUMENTS

| | | |
|---|---|---|
| AT | 267128 | 10/1968 |
| EP | 0 113 256 A2 | 12/1983 |
| EP | 0 226 696 A1 | 5/1986 |
| GB | 1129386 | 11/1966 |
| GB | 1435224 | 7/1973 |
| GB | 2 029 199 A | 3/1980 |
| WO | WO 88/03462 | 5/1988 |
| WO | WO 96/39331 | 12/1996 |

OTHER PUBLICATIONS

Brochure for TL3 Programmable Tray Labeler, Sinclair International, undated (2 pg.).
Brochure for SP–RM6 Labeler, Sinclair International, undated (2 pg.).
Brochure for TL–3 Tray Labeler, Sinclair International, Apr. 29, 1999 (1 pg.).
Brochure for SP–RM6 Self Contained Labeling Head, Sinclair International, Apr. 29, 1999 (1 pg.).

*Primary Examiner*—Sue A. Purvis
(74) *Attorney, Agent, or Firm*—Leydig, Voit & Mayer, Ltd.

(57) ABSTRACT

A labeler for applying labels to articles is provided. The labeler includes a label application device having an opening in an end thereof. The label application device is expandable when subjected to pressure. The labeler also includes a positioner for supporting the label application device and moving the label application device between a label pick-up position and a label application position. A vacuum source and a pressure source are also provided which can be selectively connected to the label application device such the label application device is subject to pressure when adjacent the label application position and subject to vacuum for picking up and retaining a label on the label application device at the label pick-up position. The labeler also includes a flow control element having at least one flow control passage therein which defines at least one air flow path through the flow control element to the label application device opening. The flow control passage is configured to allow air flow through the air flow path and out the label application device opening when pressure is applied to the label application device, but being effective to delay the air flow from reaching the label application device opening.

36 Claims, 9 Drawing Sheets

U.S. PATENT DOCUMENTS

| | | | | |
|---|---|---|---|---|
| 3,318,468 | A | | 5/1967 | Olson |
| 3,440,123 | A | | 4/1969 | Hamisch, Sr. |
| 3,450,590 | A | | 6/1969 | LaMers |
| 3,611,929 | A | | 10/1971 | Schrotz et al. |
| 3,955,711 | A | | 5/1976 | Schroter et al. |
| 4,034,664 | A | | 7/1977 | Hassell |
| 4,123,310 | A | | 10/1978 | Varon et al. |
| 4,156,627 | A | | 5/1979 | Hamisch, Jr. |
| 4,191,608 | A | | 3/1980 | Bussard et al. |
| 4,217,164 | A | | 8/1980 | LaMers |
| 4,244,763 | A | | 1/1981 | Varon et al. |
| 4,253,902 | A | | 3/1981 | Yada |
| 4,303,461 | A | | 12/1981 | LaMers |
| 4,345,517 | A | | 8/1982 | Arao et al. |
| 4,347,094 | A | | 8/1982 | Watanabe |
| 4,350,087 | A | | 9/1982 | Ramirez |
| 4,454,180 | A | | 6/1984 | LaMers |
| 4,479,644 | A | | 10/1984 | Bartimes et al. |
| 4,547,252 | A | | 10/1985 | LaMers |
| 4,581,094 | A | | 4/1986 | Sato |
| 4,648,930 | A | | 3/1987 | LaMers |
| 4,681,031 | A | | 7/1987 | Austad |
| 4,842,660 | A | | 6/1989 | Voltmer et al. |
| 4,896,793 | A | | 1/1990 | Briggs et al. |
| 4,924,770 | A | | 5/1990 | Raub |
| 5,061,334 | A | | 10/1991 | Paules |
| 5,344,519 | A | | 9/1994 | Galchefski et al. |
| 5,387,302 | A | | 2/1995 | Bernard et al. |
| 5,489,360 | A | | 2/1996 | Shimizu et al. |
| 5,645,680 | A | | 7/1997 | Rietheimer |
| 5,660,676 | A | | 8/1997 | Brooks |
| 5,743,176 | A | | 4/1998 | Anderson et al. |
| 5,829,351 | A | | 11/1998 | Anderson et al. |
| 6,009,926 | A | | 1/2000 | Vicktorius et al. |
| 6,047,755 | A | | 4/2000 | Anderson et al. |
| 6,209,605 | B1 | | 4/2001 | Lee et al. |
| 6,230,779 | B1 | | 5/2001 | Anderson et al. |
| 6,257,294 | B1 | | 7/2001 | Weisbeck |
| 6,408,916 | B1 | | 6/2002 | Anderson et al. |
| 6,427,746 | B1 | * | 8/2002 | Anderson et al. ..... 156/541 |
| 2002/0026987 | A1 | | 3/2002 | Sherman et al. |

* cited by examiner

LABEL APPLICATION DEVICE INCLUDING A FLOW CONTROL ELEMENT

FIELD OF THE INVENTION

This invention relates to a labeling apparatus and more particularly, to a labeling apparatus for the application of labels to fruit and/or vegetables.

BACKGROUND OF THE INVENTION

Labels are applied to fruit and vegetables in packing houses, where the speed at which the labels are applied and the accuracy of the label application are important considerations. Speed is important because the fruit must be packed and shipped quickly so that the shelf life in stores will be as long as possible and the speed of the labeler may be a limiting constraint. The constraint of labeler speed may also result in inefficient use of other equipment and personnel in the packing house, thus increasing the overall cost of operation. Accuracy, in the form of the successful application of the proper label to the fruit, is important because packing house profitability is adversely affected when a label that would have permitted a higher selling price is not applied to fruit otherwise capable of commanding such a higher price.

One known type of labeler used to label fruit and vegetable includes an extendable bellows for placing the labels (see, e.g., U.S. Pat. No. 4,547,252 and EP 0113256). With this type of labeler, the bellows is moved past a magazine or cassette which dispenses the labels from a carrier strip. The labels are held in position on the end of the bellows by application of a vacuum to the bellows that is pulled through openings in the end of the bellows. The vacuum also serves to maintain the bellows in a retracted position. As the bellows is moved to an application position adjacent a fruit, positive pressure is applied and the bellows is extended to contact the fruit and apply the label thereto.

To prevent a label from blowing off the end of the bellows when the bellows is extended by positive air pressure and thereby missing the fruit, the bellows typically includes some sort of mechanism that prevents air from flowing out of the bellows. One such mechanism is a tricuspid check valve which is integrally formed on the distal end of the bellows. The valve admits air from outside the bellows to the interior of the bellows, but prevents the flow of air out of the bellows. Another such mechanism is a flexible diaphragm that is secured inside the distal end of the bellows. When a vacuum is applied, the diaphragm opens to expose a series of openings in the distal end of the bellows. When positive pressure is applied to extend the bellows, the flexible diaphragm seals against the openings.

Unfortunately, both the integrally formed check valve and the diaphragm arrangement are subject to becoming clogged with dirt and debris. This dirt and debris can prevent the valve or diaphragm from operating properly. For example, if the valve or diaphragm becomes stuck open, when positive pressure is applied, the label may be ejected prematurely. If the valve or diaphragm becomes gummed in a closed position, the bellows may not pick up the labels and the dispensing cassette may jam thereby requiring maintenance. As a result, the bellows must be routinely removed and washed to get rid of the build-up of dirt and debris.

Another type of mechanism used in an expandable bellows labeler to prevent the label from blowing off the end of the bellows is a spiral tube assembly. The spiral tube assembly includes a flexible coil tube that is positioned within the bellows and can be used to provide vacuum at the end of the bellows as the bellows is being expanded. Unlike a check valve or diaphragm arrangement, the spiral tube assembly is not subject to becoming clogged with dirt or debris.

However, the spiral tube assembly has several other shortcomings. For example, the spiral tube assembly consists of four parts which can be difficult to assemble correctly. As a result, the spiral tube assembly requires a relatively labor intensive and time-consuming assembly process. Additionally, because of the arrangement and movement of the parts, the spiral tube assembly has a relatively short life span. The spiral tube assembly is also difficult to service and replace. For example, the bellows must be placed in a certain orientation to allow the operator to see the fitting to which the tube is attached. The spiral tube assembly can limit the distance that the bellows can expand and also resists expansion of the bellows thereby making the bellows less responsive at higher speeds.

BRIEF SUMMARY OF THE INVENTION

A labeler for applying labels to articles is provided. The labeler includes a label application device having an opening in an end thereof. The label application device is expandable when subjected to pressure.

The labeler also includes a positioner for supporting the label application device and moving the label application device between a label pick-up position and a label application position. A vacuum source and a pressure source are also provided which can be selectively connected to the label application device such the label application device is subject to pressure when adjacent the label application position and subject to vacuum for picking up and retaining a label on the label application device at the label pick-up position.

The labeler also includes a flow control element having at least one flow control passage therein which defines at least one air flow path through the flow control element to the label application device opening. The flow control passage is configured to allow air flow through the air flow path and out the label application device opening when pressure is applied to the label application device, but being effective to delay the air flow from reaching the label application device opening to prevent the label from being blown off of the end of the bellows.

DETAILED DESCRIPTION OF THE INVENTION

Figure 1:
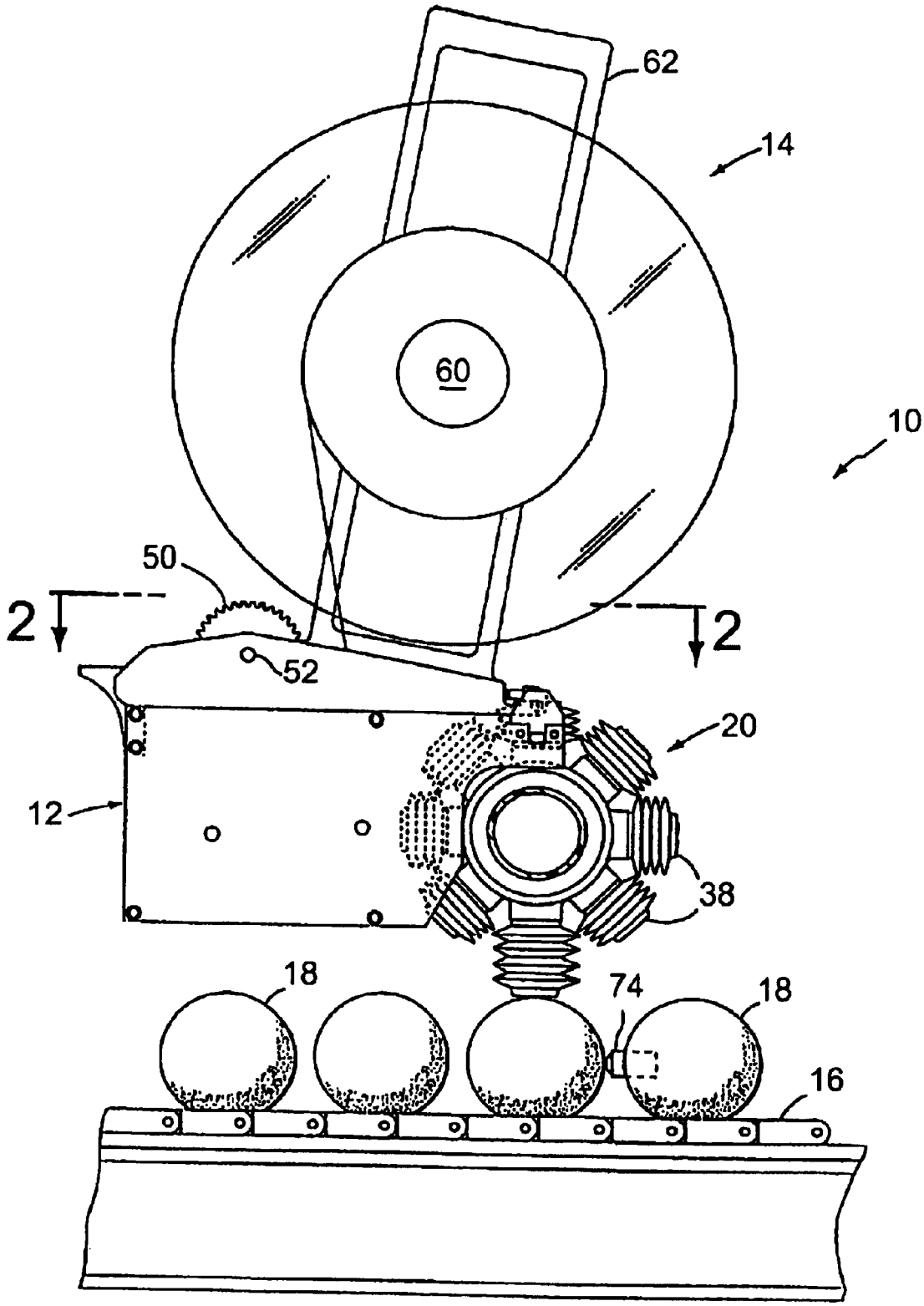
FIG. 1 is a side elevation view of an illustrative labeler according to the present invention with a labeling cassette installed.

Referring now to FIG. 1, there is shown an illustrative labeler 10 for applying labels to articles such as fruit or vegetables constructed in accordance with the teachings of the present invention. The illustrated labeler 10 includes a labeler base 12 and a label cassette 14 in engagement therewith and supported over a conveyor 16 having conventional cradles for holding and positioning individual fruit 18 or any other article to be labeled. The label cassette 14 is releasably retained on the labeler base 12 and the cassettes are interchangeable so that one cassette can be loaded off-line with a reel of a carrier bearing labels while another cassette is operatively engaged with the labeler base 12 to apply labels to the fruit.

In the illustrated embodiment, the labeler 10 includes a rotatable bellows wheel 20 that supports a plurality of expandable bellows 22 which serve, in this case, as label application devices. Each bellows is movable between extended and retracted positions responsive to positive and negative internal fluid pressure, respectively applied through, in this instance, an open end thereof. Each bellows 22 includes an end wall 24 having, at least one, but in this case multiple openings 26 therein (see, e.g., FIG. 7). Drawing negative fluid pressure or vacuum through the openings 26 in the end of the bellows 22 holds a label in position on the end of the individual bellows 22. This negative pressure or vacuum also serves to retract the bellows 22. When expanded, the individual bellows 22 extends towards the piece of fruit 14 to effect the application of a label thereto as described in greater detail below. Each bellows 22 also includes a pleated sidewall 28 connected to the end wall 24. The pleated sidewall 28 permits the bellows 22 to move between the extended and retracted positions responsive to internal fluid pressure.

Additional details regarding the illustrated labeler are provided in U.S. patent application Ser. Nos. 09,187,441 and 09/453,757 the disclosure of which is incorporated herein by reference. While the present invention is described in connection with a rotary bellows type labeler, those skilled in the art will appreciate from the following description that the invention is equally applicable to any type of labeler having a label application device that uses a vacuum for picking up a label and pressure to effect the deposit of a label on an article. For example, instead of a bellows, the label application device could comprise a piston, an expandable balloon-type mechanism or any other mechanism which is expandable when subject to pressure.

Figure 2:
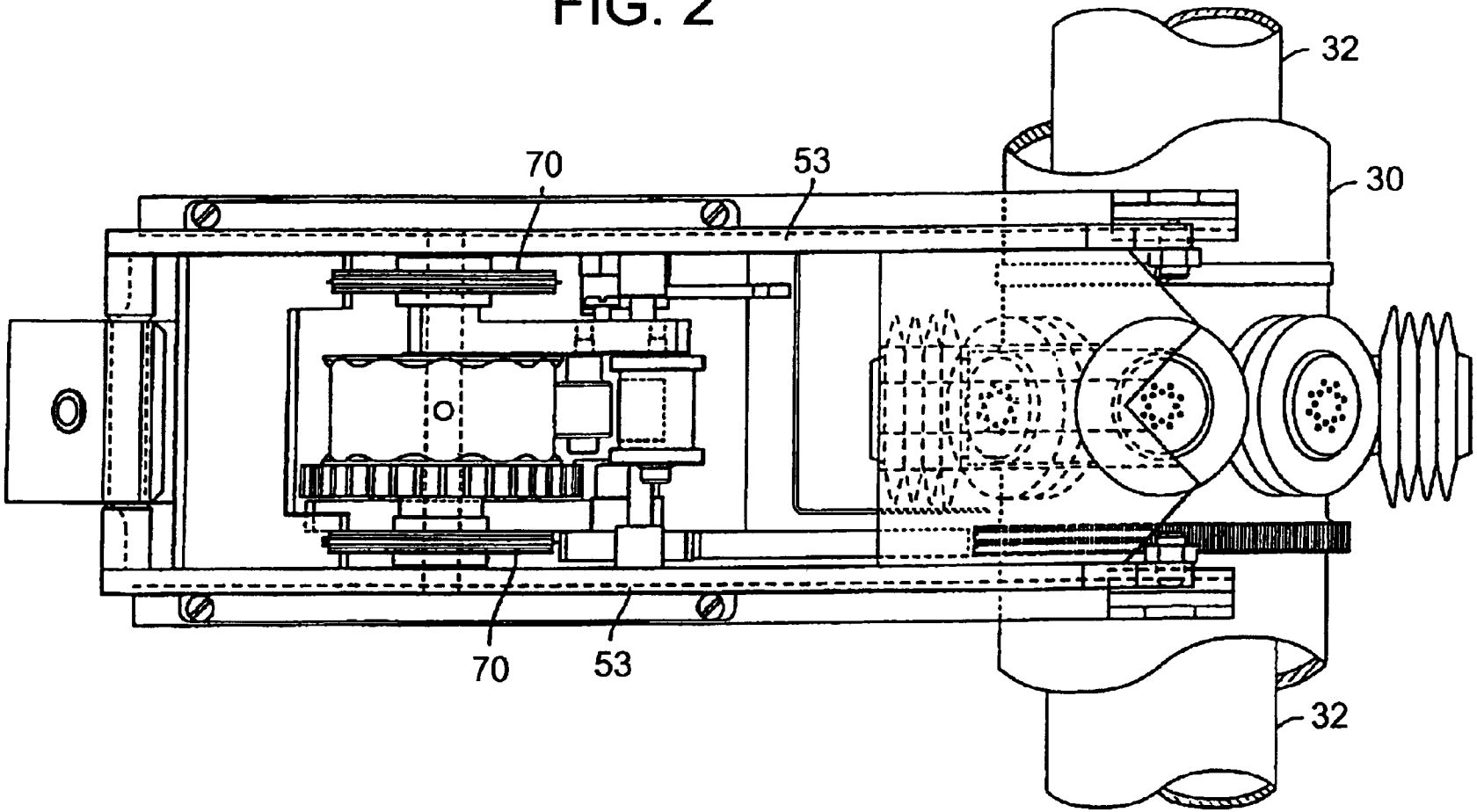
FIG. 2 is a cross-sectional view taken along the line 2—2 of FIG. 1.
Figure 3:
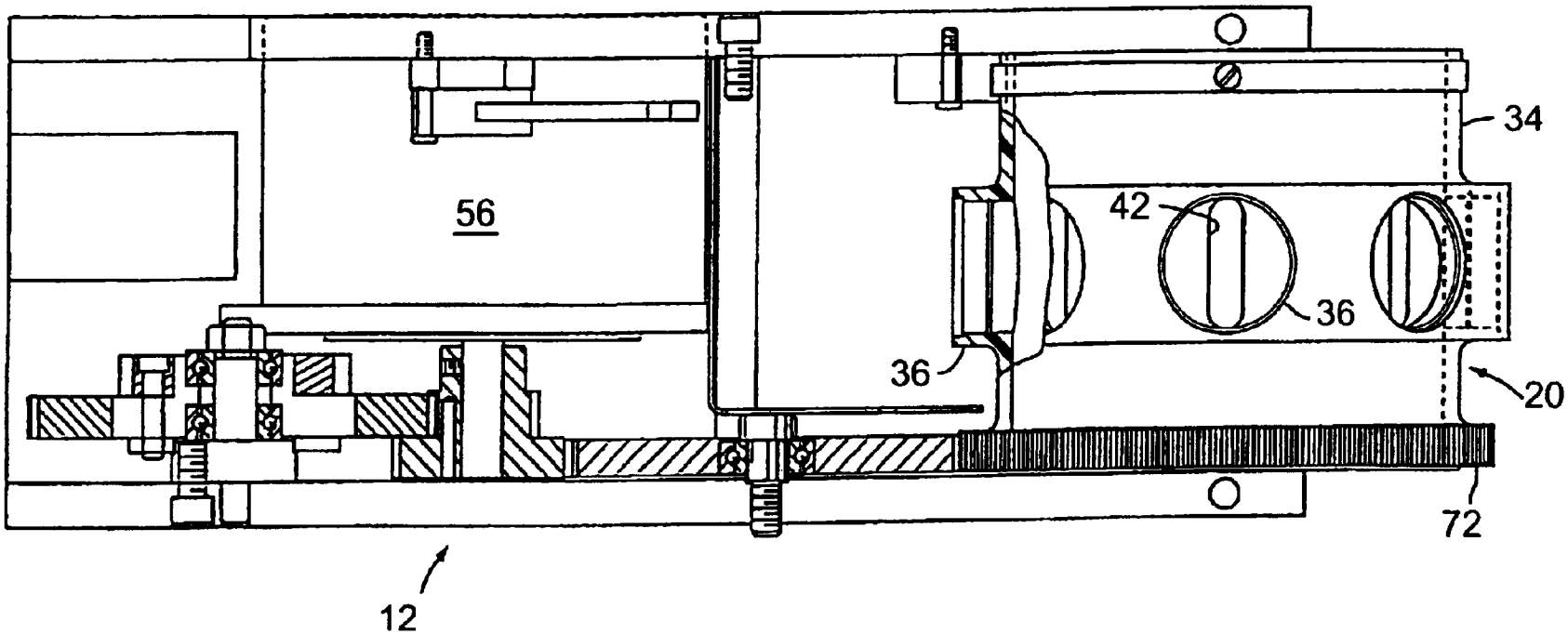
FIG. 3 is a partially cut away top plan view of the labeler of FIG. 1 with the labeling cassette removed.
Figure 4:
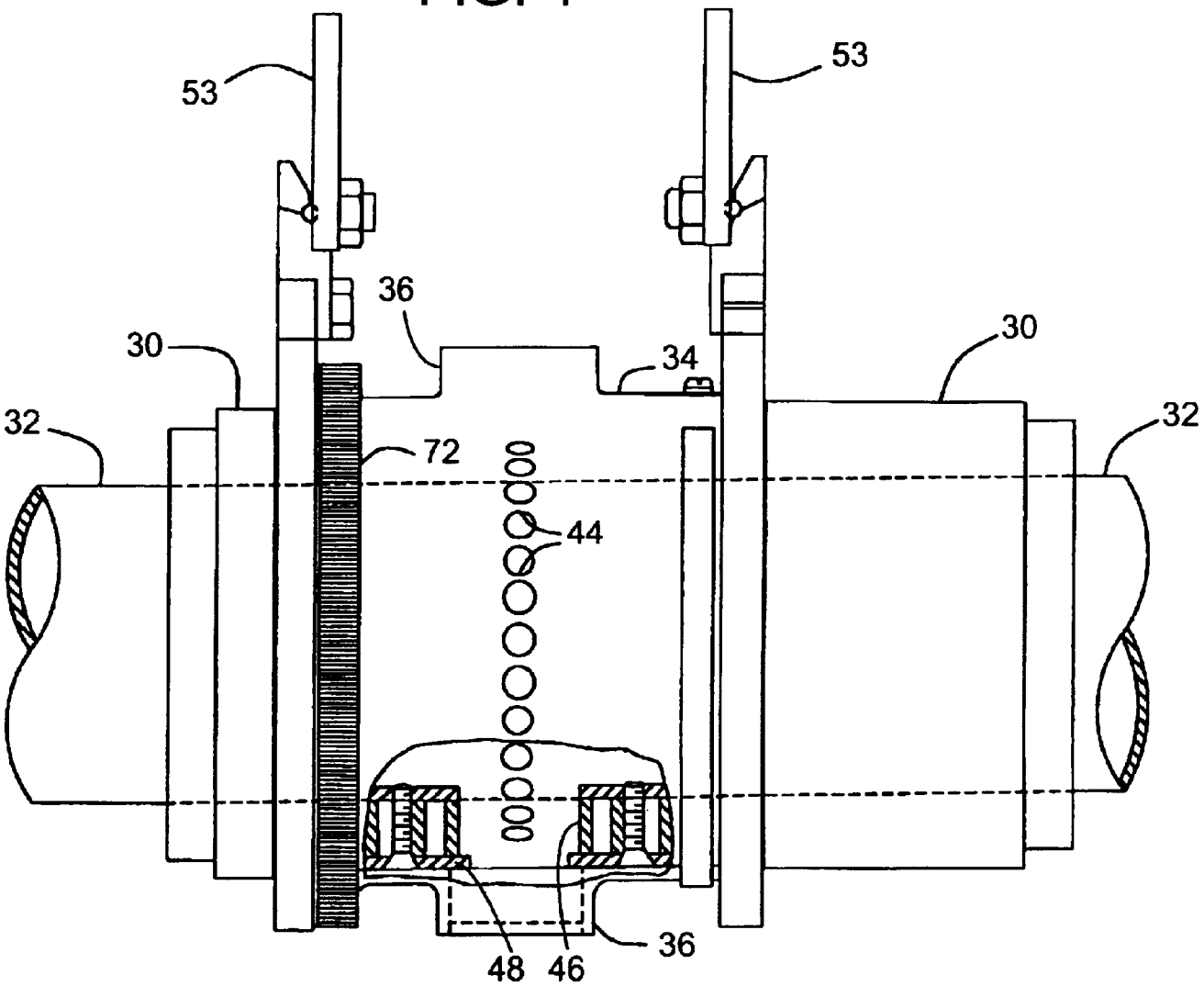
FIG. 4 is a top plan view of a portion of the labeler of FIG. 1 showing the bellows wheel.

For retracting the individual bellows 22, the labeler 10 is connected to a vacuum tube 30 (see FIG. 2) that is in turn connected to a vacuum source in a known manner. Additionally, for effecting extension of the bellows, a pressure tube 32 is provided which in this case extends along the interior of the vacuum tube 30. The pressure tube 32 is connected to a source of air pressure, which may be a conventional blower. As best shown in FIGS. 3 and 4, the bellows wheel 20 has a tubular portion 34 which is rotatable on and sealingly engageable on its ends with the vacuum tube 30. In this case, eight cylindrical projections 36 are provided around the periphery of the tubular member 34.

Figure 7:
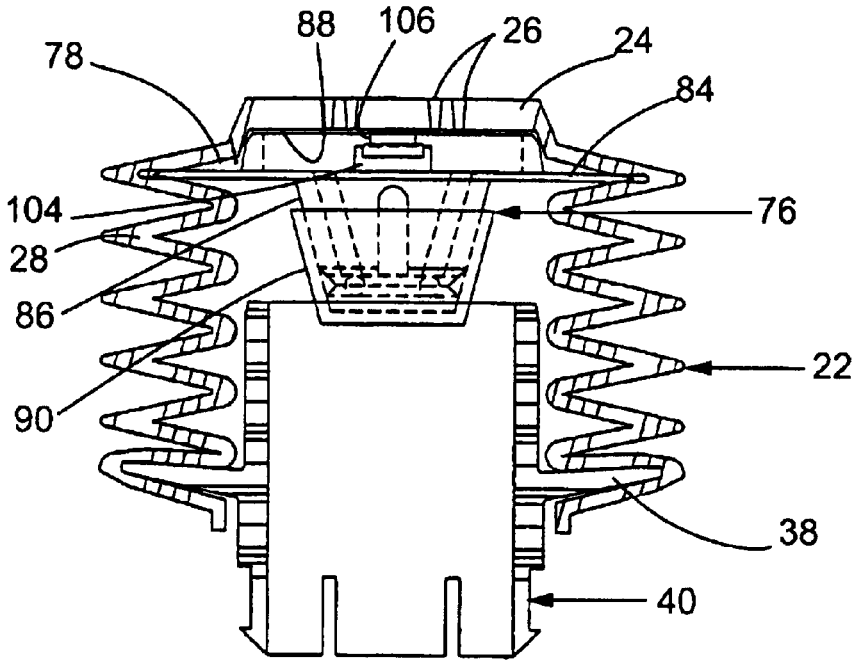
FIG. 7 is a side sectional view of one of the bellows showing the flow control element.

A flexible bellows is provided for each of the projections 36. Each of the bellows 22 is retained by an outward projecting flange 38 on a relatively rigid cup 40 having a slotted end for insertion into a cylindrical projection 36 as shown in FIG. 7. A lip formed on the slotted end snaps into an internal groove in the projection 36 to releaseably retain the cup 40 in place. Holes in the outer end of the cup 40 communicate pressure or vacuum in the projection 36 to the associated bellows 22. The cup 40 can also function to limit the amount of collapse for the associated bellows when subjected to vacuum.

For controlling the extension and retraction of each of the flexible bellows 22 so as to allow application of a label to an article, the illustrated labeler 10 is configured to selectively connect each of the bellows 22 to the vacuum and pressure sources such that each of the individual bellows is subjected to pressure when adjacent a label application position and subjected to vacuum for picking up a label at a label pick-up position. To this end, each of the cylindrical projections 36 is provided with a slot 42 to permit communication with the tube 30 via a plurality of equally spaced radial holes 44 as shown in FIGS. 3 and 4. A cross tube 46 is connected, and communicates air pressure, between the pressure tube 32 and a slot 48 in the vacuum tube 30 at the six o'clock position.

The width of the slots 42 in the projections is wider than the space between the holes 44 so that vacuum is always available to each projection 36, except when the projection is at the six o'clock position. As the slot 42 for each projection 36 rotationally approaches that position, vacuum access is interrupted and communication with the pressure slot 48 is initiated. Similarly, as each projection rotationally leaves the 6 o'clock position, pressure is cut-off just before access to vacuum is permitted. Thus, the bellows 22 are contracted throughout the rotation of the tubular member 34 except when in proximity to the six o'clock position. It is in that position that each of the bellows 22 is extended toward the fruit to effect the application of a label thereto. Of course, other arrangements for controlling the extension and retraction of the bellows could be employed.

Figure 5:
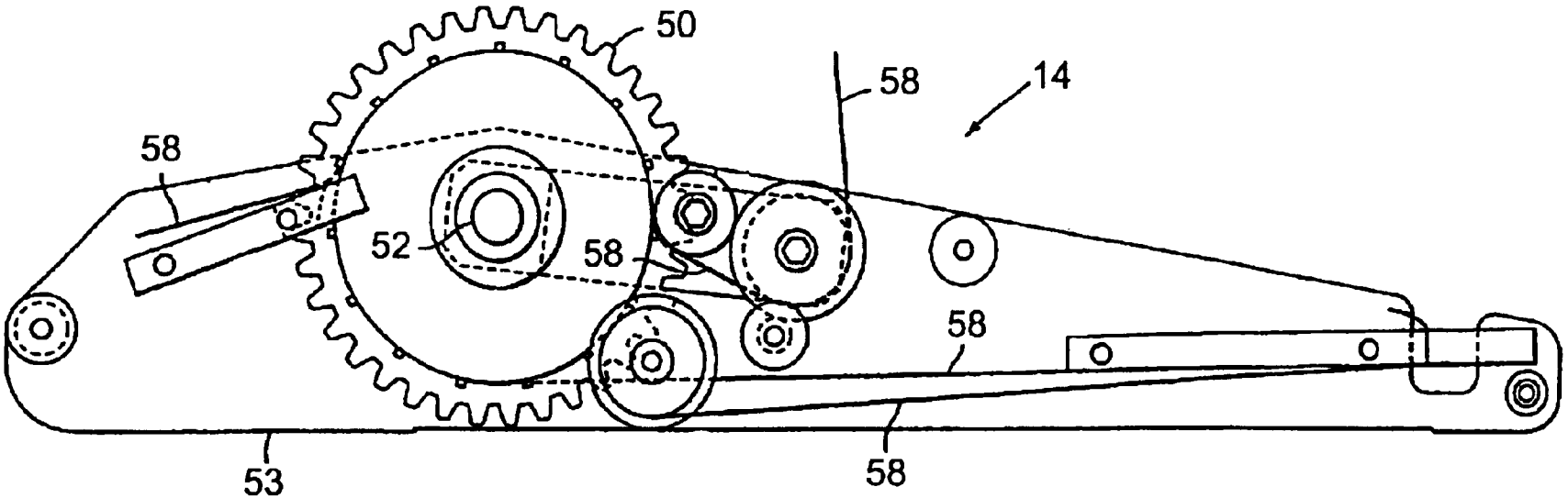
FIG. 5 is a side elevation view of the label cassette for the labeler of FIG. 1.
Figure 6:
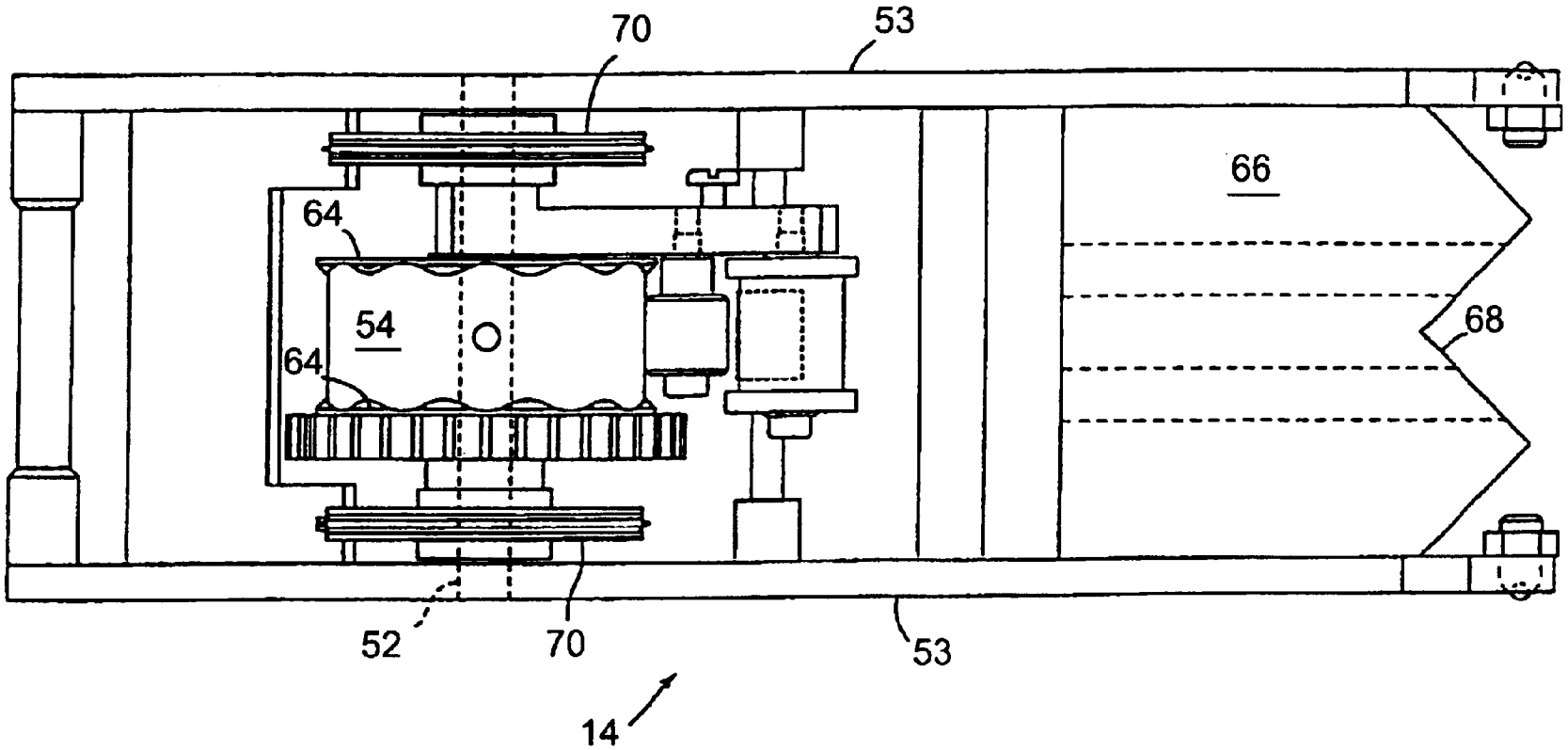
FIG. 6 is a top plan view of the label cassette of FIG. 5.

For feeding labels to the individual bellows 22, the label cassette 14 includes a label feed mechanism. A drive mechanism 56 is also provided which, in this case, is operable to advance the label feed mechanism. The illustrated label feed mechanism includes a cassette sprocket 50 carried on a shaft 52 supported by a cassette frame 53 and a hub 54 which is also affixed to the shaft 52 as shown in FIGS. 5 and 6. The cassette sprocket 50 is linked via gearing to the drive mechanism 56, which in the illustrated embodiment includes a numerically controlled motor, such as a stepper motor, contained in the labeler base 12 (see FIG. 3). The label cassette 14 further includes a label carrier strip 58 having a plurality of labels carried thereon is wound on a reel 60 which is rotatably supported on handles 62 as shown in FIGS. 1 and 5. The label carrier strip 58 from the reel 60 is drawn around the hub 54 such that when operation of the drive mechanism though the sprocket 50 causes the hub 54 to rotate, the carrier strip 58 is unwound from the reel 60. In this instance, the hub 54 has a depressed center section with sinusoidal side walls 64 (see, e.g. FIG. 6). The sinusoidal side walls 54 engage complementarily shaped edges of a label carrier strip 58 in order to facilitate accurate positioning and advancement of the carrier strip.

After being drawn around the hub 54, the label feed mechanism advances the carrier strip 58 along a separation plate 66 (see FIG. 6) which separates the labels from the carrier strip. The illustrated separation plate is particular designed for a carrier strip 58 that includes a line of weakness down its middle forming separate halves. The labels are attached over both halves of the carrier strip. To separate the labels from the carrier strip, the separation includes a V-shaped notch 68 with each half of the carrier strip 58 being drawn over a different side of the V-shaped notch. This causes the two halves of the carrier strip 58 to follow divergent paths from each other, and also from the label thereby forcibly releasing the label from the label strip for pick-up by one of the bellows 22. Each half of the separated carrier is then drawn back from the V-shaped notch 68 and wound around a respective take-up wheel 70. It will be appreciated by those skilled in the art that the present invention is not limited to the particular label feed and separation mechanism shown or to label strips having sinusoidal shaped edges.

To rotate the bellows wheel 20, the drive assembly 56 is linked to a gear 72 (see FIG. 3) on the bellows wheel. In the illustrated embodiment, the drive assembly is activated by a fruit sensing switch 74 that is positioned besides the conveyor 16 to detect the approach of a piece of fruit in a cradle on the conveyor as shown in FIG. 1. Upon activation, the drive assembly advances the label feed mechanism to feed a label to the bellows wheel 20 and the bellows wheel 20 to effect the depositing of a label retained on an individual bellows 22 on an article positioned at a label application position.

In accordance with the invention, to ensure that the label is not prematurely blown off of the end of the bellows 22 as the bellows 22 is extended, each bellows 22 includes a flow control element 76 which delays the application of pressure to the end of the bellows when the bellows is extended. To this end, the flow control element 76 is arranged adjacent the openings 26 in the end wall 24 of the bellows 22 (see FIG. 7) so as to effectively separate the openings 26 from the remainder of the bellows and the open thereof through which the vacuum and pressure are applied. The flow control element 76 further includes at least one air flow or flow control passage and, in the illustrated embodiment, a plurality of air flow passages that allow fluid communication between the end openings 26 and the open end of the bellows. Thus, when pressure is applied through the open end of the bellows, the air flow must pass through one or more air flow paths through the flow control element that are defined by the air flow passages to reach the end openings in the bellows.

The air flow passages allow air flow through the flow control element 76 whether positive or negative pressure is being applied to the bellows 22. However, the air flow passages are configured such that the one or more air flow paths to the end openings 26 are sufficiently long, narrow and/or tortuous such that when pressure is applied to the bellows 22 through the open end 82 thereof there is a delay in the air flow reaching the end chamber. This delay prevents the label from being blown off the end of the bellows 22 as the bellows 22 is being extended. It will be appreciated that this delay can be accomplished with a single air flow passage defining a single air flow path through the flow control element, with multiple interconnected air flow passages defining a single path through the flow control element or with multiple air flow passages defining multiple paths through the flow control element as in the illustrated embodiment.

To ensure that air flow does not bypass the air flow passages, the illustrated flow control element 76 divides the bellows so as define an end chamber 78 that communicates with the openings 26 in the end wall 24 of the bellows 22. Thus, in this case, the flow control element is configured to engage the side wall 28 of the bellows 22 near the end wall 24 thereof so as to inhibit the flow of air around the perimeter of the flow control element 76. The illustrated flow control element 76 includes a thin disk shaped portion 84 and a cone shaped portion 86 extending outward from, in this case, the center of one side of the disk shaped portion 84. When installed in the bellows 22, the disk portion 84 extends into engagement with the side wall 28 of the bellows 22 while the cone portion 86 extends inward towards the open end 82 of the bellows as shown in FIG. 7. In particular, the flow control element 76 can be arranged in the bellows 22 such that the circumferential edges of the disk portion 84 of the element extend into and engage the first pleat of the side wall 28 of the bellows near the end wall 24 of the bellows. In the illustrated embodiment, the disk portion further includes an annular ring 88 that protrudes from the side of the disk portion 84 opposite the cone portion 86 to provide the disk member 84 with additional structural rigidity.

The cone portion 86 of the flow control element 76 provides a thicker or enlarged section of the element within which the air flow passages can be provided. In particular, the enlarged size of the cone portion 86 allows the air flow passages to be of sufficient length so as to provide the desired delay in the flow of air to the openings 26 in the end wall 24 of the bellows 22. The use of a configuration featuring a relatively thinner portion that engages the side wall 28 of the bellows 22 and a relatively thicker portion for housing the air passages also ensures that the flow control element 76 is relatively lightweight and requires a minimal amount of space. However, while the illustrated configuration can provide certain advantages, those skilled in the art will appreciate that the flow control element can have any suitable configuration which separates the end openings 26 from the remainder of the bellows such that air flow to and from the end openings 26 caused by the application of pressure and vacuum to the bellows passes through the one or more air flow passages in the flow control element. For example, the flow control element 76 could be attached directly to the inside face of the end wall 24 of the bellows 22 or molded into the end wall 24 itself.

Figure 8:
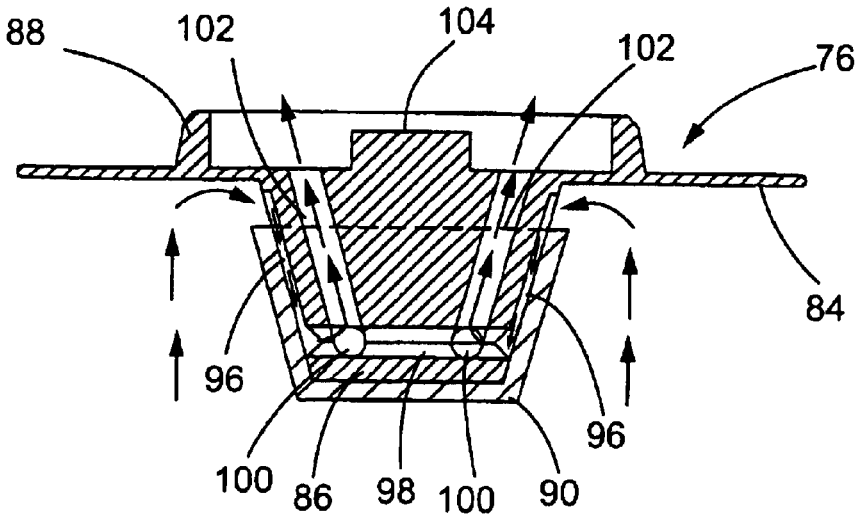
FIG. 8 is a side sectional view of the flow control element of FIG. 7 showing the air flow paths through the flow control element.
Figure 11:
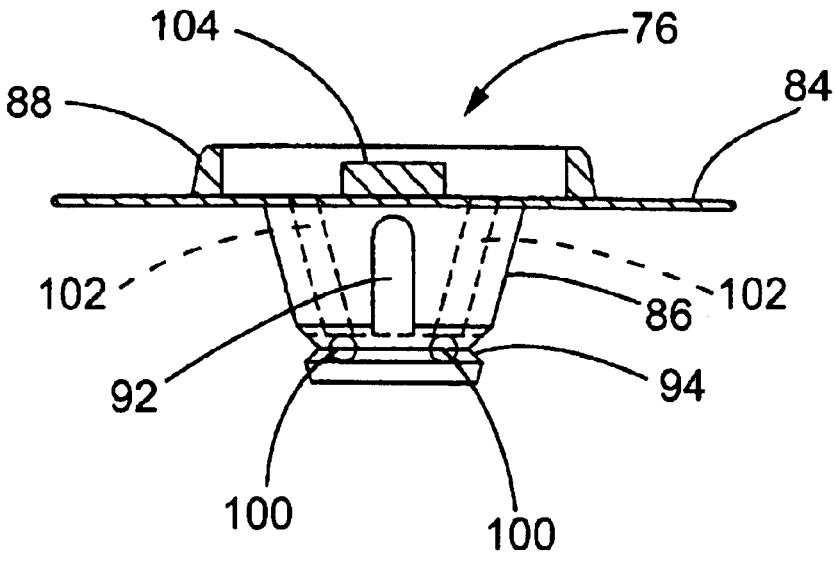
FIG. 11 is a side elevation view of the flow control element of FIG. 7 with the cap portion removed.
Figure 12:
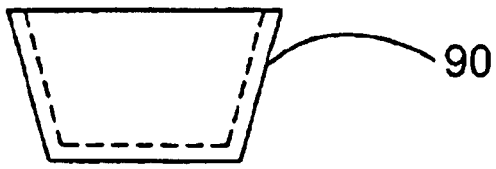
FIG. 12 is a side elevation view of the cap portion of the flow control element of FIG. 7.

To ensure that there is a suitable delay in the flow of air through the flow control element 76, the air flow passages in the illustrated embodiment are interconnected so as to provide multiple continuous air flow paths through the flow control element. The air flow passages include passages which extend through the cone portion 86 as well as passages defined by recesses or grooves in the surface of the cone portion 86 and a cap 90 which is arranged over the cone portion. In particular, two longitudinally extending grooves 92 (one of which is shown in FIG. 11) are provided on the outer surface of the cone portion 86. These longitudinal grooves 92 intersect a circumferential groove 94 that is provided in the outer surface of the cone portion 86 near the end thereof as shown in FIG. 11. When the cap portion 90 is assembled over the cone portion 86, the gaps between the cap 90 and the outer surface of the cone portion 86 created by the longitudinal grooves 92 define longitudinally extending air flow passages 96 in the cone portion 86 as best shown in FIG. 8. Likewise, the gap created by the circumferential groove 94 defines a circumferential air flow passage 98 in the cone portion 86. The cap 90 can be secured to the cone portion 86 using any suitable method such as for example glue or sonic welding. The use of a cap is of course optional, and when used, the cap can have any configuration that allows air flow passages to be defined by grooves in the surface of the flow control element and the inside surface of the cap.

Figure 9:
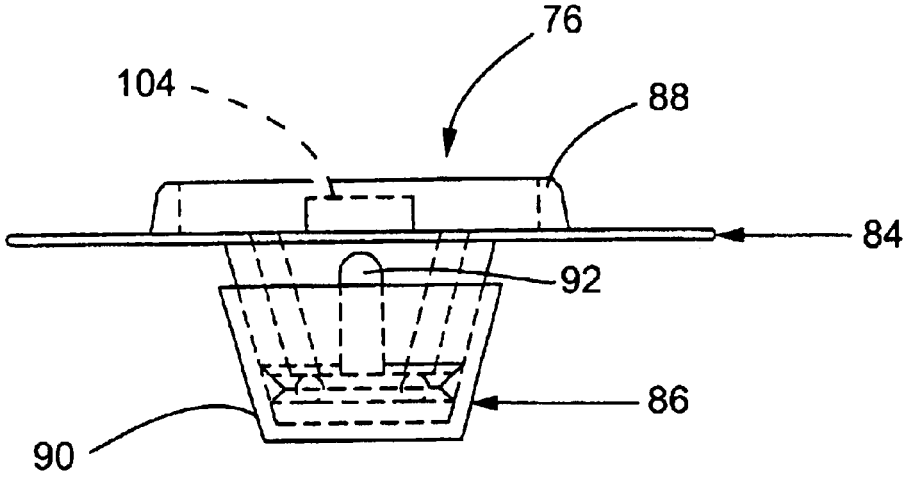
FIG. 9 is a side elevation view of the flow control element of FIG. 7.
Figure 10:
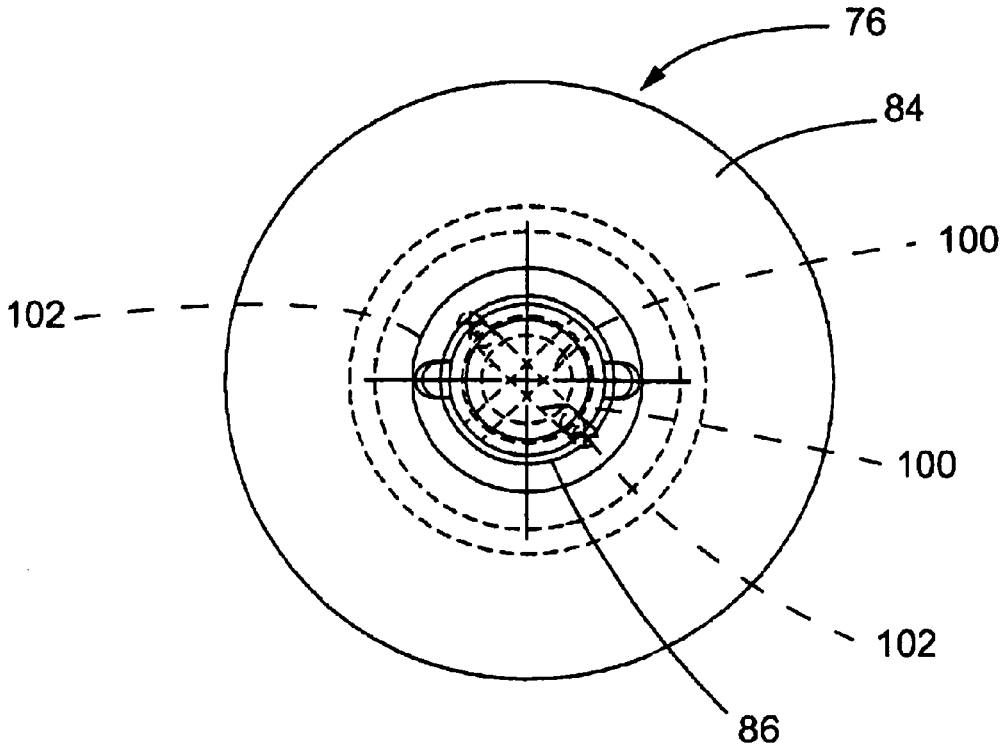
FIG. 10 is a bottom plan view of the flow control element of FIG. 7.

As shown in FIG. 10, the air flow passages in the cone portion 86 of the illustrated air flow control element 76 further include a pair intersecting radial air flow passages 100 each of which communicates at either end with the circumferential air flow passage 98. In this instance, one of the radial passages 100 further communicates with a pair of interior air flow passages 102 which extend through the cone portion to the opposite side of the element. As shown in FIGS. 8, 9 and 11, the interior air flow passages 102 are angled such that each passage extends parallel to the exterior surface of the cone portion 86. In the illustrated embodiment, the flow passages are arranged symmetrically with respect to the cone portion 86 to ensure that the forces applied to the flow control element 76 are properly balanced.

FIG. 8 illustrates the flow of air through these passages when pressure is applied to extend the bellows 22. As shown, the air flows underneath the cap 90 along the longitudinal air passages 96 to the circumferential passages 98. The air then flows through the intersecting radial passages 100 and from there through the interior passages 102 to the chamber 78 at the end of the bellows 22. Thus, the illustrated network of air flow passages provide continuous but relatively narrow and tortuous paths for air to travel to and from the end chamber 78. Accordingly, when pressure is applied to extend the bellows 22, there will be a delay before that pressure reaches the end chamber 78 and causes air flow out of the openings 26 in the end of the bellows 22. This delay is long enough to ensure that the label is held on the end of the expanding bellows until it is applied to an article. Of course, the flow control element 76 produces a similar delay in air flow when the bellows 22 is subjected to a vacuum. Thus, the bellows 22 should be connected to the vacuum source sufficient time in advance of reaching the label pick-up position to ensure that a vacuum is being drawn through the openings 26 in the end wall 24 of the bellows 22 when a new label is picked-up.

To ensure proper relative positioning of the flow control element 76 and the end wall 24 of the bellows 22 as the bellows moves between the extended and retracted positions, a projection 104 can be provided on the side of the flow control element 76 facing the end wall of the bellows. As shown in FIG. 7, this projection 104 defines a first stop surface which is engageable with a second stop surface defined by a mating projection 106 on the inside surface of the end wall 24 of the bellows 22. These mating projections 104, 106 ensure that the end wall 24 of the bellows 22 remains spaced from the flow control element 76 even when the bellows is retracted.

From the foregoing, it can be seen that the flow control element of the present invention provides several significant advantages over the check valve arrangement and the coil tube arrangement used in known labelers. With respect to the coil tube arrangement, the flow control element of the present invention utilizes fewer parts and therefore is significantly easier and cheaper to assemble as well as replace. Moreover, the flow control element also does not use any moving parts and therefore has a longer life span. The flow control element also allows the bellows to be more responsive at higher speeds because it eliminates the need for the coil tube that limits and resists expansion of the bellows. With respect to the check valve arrangement, the flow control element is not subject to becoming clogged with dirt or debris.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A labeler for applying labels to articles comprising:

a label application device having an opening therein, the label application device being expandable when subjected to air pressure; and a flow control element having at least one flow control passage therein which defines at least one air flow path extending from an interior of the label application device through the flow control element to the label application device opening, the flow control passage being configured such that when air pressure is applied to the interior of the label application device said air flows from the interior of the label application device through the air flow path and out the label application device opening, but the flow control passage being effective to delay the air flow from reaching the label application device opening.

2. The labeler according to claim 1 wherein the flow control passage is one of a plurality of flow control passages which define at least one air flow path from the interior of the label application device through the flow control element to the label application device opening.

3. The labeler according to claim 2 wherein the plurality of air flow passages define multiple continuous air flow paths through the flow control element.

4. The labeler according to claim 2 wherein the flow control element further includes a cap arranged over at least a portion of the flow control element.

5. The labeler according to claim 4 wherein at least one of the flow control passages is defined by a recess in an exterior surface of the flow control element and an inside surface of the cap.

6. The labeler according to claim 5 wherein another of the flow control passages comprises a passage extending through an interior portion of the flow control element.

7. The labeler according to claim 1 wherein the flow control element has a protrusion thereon which defines a stop surface between the flow control element and an end of the label application device.

8. The labeler according to claim 1 wherein the label application device is a bellows.

9. The labeler according to claim 1 wherein the flow control element is arranged in an interior portion of the label application device.

10. The labeler according to claim 1 wherein the flow control element comprises a disk portion that engages a side wall of the label application device and an enlarged portion within which the flow control passage is provided, the enlarged portion being relatively thicker than the disk portion.

11. The labeler according to claim 10 wherein the flow control passage is one of a plurality of flow control passages and the flow control element further includes a cap arranged over the enlarged portion such that at least one of the flow control passages is defined by a recess in the surface of the enlarged portion and an inside surface of the cap.

12. The labeler according to claim 10 wherein the flow control element defines an end chamber in fluid communication with the label application device opening.

13. The labeler according to claim 1 wherein the flow control passage delays the air flow from reaching the label application device opening by constricting the air flow.

14. A labeler for applying labels to articles comprising:

a label application device having an opening therein, the label application device being expandable when subjected to air pressure and being movable between a label pick-up position and a label application position;

a vacuum source and a pressure source which may be selectively connected to the label application device such that the label application device is subject to pressure when adjacent the label application position and subject to vacuum for picking up and retaining a label on the label application device at the label pick-up position; and a flow control element having at least one flow control passage therein which defines at least one air flow path extending from an interior of the label application device through the flow control element to the label application device opening, the flow control passage being configured such that when air pressure is applied to the interior of the label application device said air flows from the interior of the label application device through the air flow path and out the label application device opening, but the flow control passage being effective to delay the air flow from reaching the label application device opening.

15. The labeler according to claim 14, wherein the flow control passage is one of a plurality of flow control passages which define at least one air flow path from the interior of the label application device through the flow control element to the label application device opening.

16. The labeler according to claim 15 wherein the plurality of air flow passages define multiple continuous air flow paths through the flow control element.

17. The labeler according to claim 15 wherein the flow control element further includes a cap arranged over at least a portion of the flow control element.

18. The labeler according to claim 17 wherein at least one of the flow control passages is defined by a recess in an exterior surface of the flow control element and an inside surface of the cap.

19. The labeler according to claim 18 wherein another of the flow control passages comprises a passage extending through an interior portion of the flow control element.

20. The labeler according to claim 14 wherein the flow control element has a protrusion thereon which defines a stop surface between the flow control element and an end of the label application device.

21. The labeler according to claim 14 wherein the label application device is a bellows.

22. The labeler according to claim 14 wherein the flow control element is arranged in an interior portion of the label application device.

23. The labeler according to claim 14 wherein the flow control element comprises a disk portion that engages a side wall of the label application device and an enlarged portion within which the flow control passage is provided, the enlarged portion being relatively thicker than the disk portion.

24. The labeler according to claim 23 wherein the flow control passage is one of a plurality of flow control passages and the flow control element further includes a cap arranged over the enlarged portion such that at least one of the flow control passages is defined by a recess in the surface of the enlarged portion and an inside surface of the cap.

25. The labeler according to claim 14 wherein the flow control passage delays the air flow from reaching the label application device opening by constricting the air flow.

26. A labeler for applying labels to articles comprising:

a label application device having an opening therein, the label application device being expandable when subjected to air pressure;

a positioner for supporting the label application device and moving the label application device between a label pick-up position and a label application position;

a vacuum source and a pressure source which may be selectively connected to the label application device such the label application device is subject to pressure when adjacent the label application position and subject to vacuum for picking up and retaining a label on the label application device at the label pick-up position; and a flow control element having at least one flow control passage therein which defines at least one air flow path extending from an interior of the label application device through the flow control element to the label application device opening, the flow control passage being configured such that when air pressure is applied to the interior of the label application device said air flows through the air flow path and out the label application device opening, but the flow control passage being effective to delay the air flow from reaching the label application device opening.

27. The labeler according to claim 26 wherein the flow control passage is one of a plurality of flow control passages which define at least one air flow path from the interior of the label application device through the flow control element to the label application device opening.

28. The labeler according to claim 27 wherein the plurality of air flow passages define multiple continuous air flow paths through the flow control element.

29. The labeler according to claim 27 wherein the flow control element further includes a cap arranged over at least a portion of the flow control element.

30. The labeler according to claim 29 wherein at least one of the flow control passages is defined by a recess in an exterior surface of the flow control element and an inside surface of the cap.

31. The labeler according to claim 30 wherein another of the flow control passages comprises a passage extending through an interior portion of the flow control element.

32. The labeler according to claim 26 wherein the label application device is a bellows.

33. The labeler according to claim 26 wherein the positioner is a bellows wheel.

34. The labeler according to claim 26 wherein the flow control element is arranged in an interior portion of the label application device.

35. The labeler according to claim 34 wherein the flow control element comprises a disk portion that engages a side wall of the label application device and an enlarged portion within which the flow control passage is provided, the enlarged portion being relatively thicker than the disk portion.

36. The labeler according to claim 26 wherein the flow control passage delays the air flow from reaching the label application device opening by constricting the air flow.

* * * * *